US009068701B2

(12) United States Patent
Progl

(10) Patent No.: US 9,068,701 B2
(45) Date of Patent: Jun. 30, 2015

(54) LAMP STRUCTURE WITH REMOTE LED LIGHT SOURCE

(75) Inventor: Curt Progl, Raleigh, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/358,901

(22) Filed: Jan. 26, 2012

(65) Prior Publication Data

US 2013/0194796 A1 Aug. 1, 2013

(51) Int. Cl.

| | |
|---|---|
| ***F21V 29/00*** | (2006.01) |
| ***F21K 99/00*** | (2010.01) |
| *F21Y 111/00* | (2006.01) |
| *F21V 3/00* | (2015.01) |
| *F21Y 101/02* | (2006.01) |
| *F21V 29/77* | (2015.01) |

(52) U.S. Cl.

CPC ..... *F21K 9/135* (2013.01); *F21K 99/00* (2013.01); *F21Y 2111/007* (2013.01); *F21V 29/006* (2013.01); *F21V 3/00* (2013.01); *F21Y 2101/02* (2013.01); *F21V 29/773* (2015.01); *F21V 29/777* (2015.01)

(58) Field of Classification Search

CPC ... F21K 9/135; F21K 99/00; F21Y 2111/007; F21Y 2101/02; F21V 29/777; F21V 29/773; F21V 29/006; F21V 3/00

USPC ..... 362/480, 546, 547, 218, 294, 555, 362/249.01, 249.02, 367, 373–375, 368, 362/240, 362, 363, 311.02, 221, 97.3, 646, 362/84, 307; 313/20, 45–46, 317, 113, 110; 257/81; 439/487

See application file for complete search history.

(56) References Cited

U.S. PATENT DOCUMENTS

| | | | | |
|---|---|---|---|---|
| 3,143,592 | A | 8/1964 | August | 174/16.3 |
| 3,581,162 | A | 5/1971 | Wheatley | |
| 4,204,246 | A | 5/1980 | Arii et al. | 361/699 |
| 4,727,289 | A | 2/1988 | Uchida | |
| 5,140,220 | A | 8/1992 | Hasegawa | |

(Continued)

FOREIGN PATENT DOCUMENTS

| | | |
|---|---|---|
| CN | 1425117 | 6/2003 |
| CN | 1465106 A | 12/2003 |

(Continued)

OTHER PUBLICATIONS

Office Action of the IPO for Taiwan Patent Application No. TW 100300962 issued Nov. 21, 2011.

(Continued)

*Primary Examiner* — Anne Hines
*Assistant Examiner* — Jose M Diaz
(74) *Attorney, Agent, or Firm* — Koppel, Patrick, Heybl & Philpott

(57) ABSTRACT

LED based lamps and bulbs are disclosed that comprise an elevating element to arrange LEDs above the lamp or bulb base. The elevating element can at least partially comprise a thermally conductive material. A heat sink structure is included, with the elevating element thermally coupled to the heat sink structure. A diffuser can be arranged in relation to the LEDs so that at least some light from the LEDs passes through the diffuser and is dispersed into the desired emission pattern. In some lamps and bulbs utilize a heat pipe for the elevating elements, with heat from the LEDs conducting through the heat pipe to the heat sink structure where it can dissipate in the ambient.

39 Claims, 5 Drawing Sheets

(56) References Cited

U.S. PATENT DOCUMENTS 5,463,280 A 10/1995 Johnson
5,535,230 A 7/1996 Abe
5,561,346 A 10/1996 Byrne
5,581,683 A 12/1996 Bertignoll
5,585,783 A 12/1996 Hall
5,655,830 A 8/1997 Ruskouski
5,688,042 A * 11/1997 Madadi et al. ..... 362/240
5,806,965 A 9/1998 Deese
5,850,126 A 12/1998 Kanbar
5,890,794 A 4/1999 Abtahi et al.
5,931,570 A 8/1999 Yamuro
5,947,588 A 9/1999 Huang
5,949,347 A 9/1999 Wu
5,956,106 A 9/1999 Petersen
5,959,316 A 9/1999 Lowery
6,220,722 B1 4/2001 Begemann
6,227,679 B1 5/2001 Zhang et al.
6,234,648 B1 5/2001 Borner et al.
6,250,774 B1 6/2001 Begemann et al.
6,270,722 B1 8/2001 Yang et al. ..... 422/37
6,276,822 B1 8/2001 Bedrosian et al.
6,350,041 B1 2/2002 Tarsa et al. ..... 362/231
6,404,131 B1 6/2002 Kawano et al. ..... 315/82
6,465,961 B1 10/2002 Cao ..... 315/58
6,517,221 B1 2/2003 Xie ..... 362/373
6,523,978 B1 2/2003 Huang
6,550,953 B1 4/2003 Ichikawa et al.
6,634,770 B2 10/2003 Densen
6,659,632 B2 12/2003 Chen
6,709,132 B2 3/2004 Ishibashi
6,746,885 B2 6/2004 Cao ..... 438/26
6,803,607 B1 10/2004 Chan et al.
6,848,819 B1 2/2005 Arndt et al.
6,864,513 B2 3/2005 Lin et al.
6,910,794 B2 6/2005 Rice ..... 362/547
6,948,829 B2 9/2005 Verdes et al.
6,982,518 B2 1/2006 Chou et al.
7,048,412 B2 5/2006 Martin et al.
7,080,924 B2 7/2006 Tseng et al.
7,086,756 B2 8/2006 Maxik
7,086,767 B2 8/2006 Sidwell et al.
7,094,362 B2 8/2006 Setlur et al. ..... 252/301
7,140,753 B2 11/2006 Wang et al. ..... 362/294
7,144,135 B2 12/2006 Martin et al.
7,160,012 B2 1/2007 Hilscher et al. ..... 362/555
7,165,866 B2 1/2007 Li
7,172,314 B2 2/2007 Currie et al.
7,213,940 B1 5/2007 Van De Ven
D546,980 S 7/2007 Lo
7,270,446 B2 9/2007 Chang et al. ..... 362/294
D553,267 S 10/2007 Yuen
7,345,320 B2 * 3/2008 Dahm ..... 257/99
7,350,936 B2 4/2008 Ducharme et al. ..... 362/231
7,354,174 B1 4/2008 Yan
7,377,674 B2 5/2008 Klinkman et al. ..... 362/484
7,396,142 B2 7/2008 Laizure, Jr. et al.
7,405,857 B2 7/2008 Ma et al. ..... 359/261
D581,556 S 11/2008 To et al. ..... D26/2
7,547,124 B2 6/2009 Chang et al. ..... 362/373
7,549,782 B2 6/2009 Ng et al. ..... 362/555
7,600,882 B1 10/2009 Morejon et al.
7,607,802 B2 10/2009 Kang et al. ..... 362/294
7,614,759 B2 11/2009 Negley
7,618,157 B1 11/2009 Galvez
7,663,315 B1 2/2010 Hulse ..... 313/512
7,674,015 B2 * 3/2010 Chien ..... 362/294
7,686,478 B1 3/2010 Hulse et al. ..... 362/255
7,726,836 B2 6/2010 Chen
7,740,365 B2 6/2010 Huttner et al. ..... 362/97
7,753,568 B2 7/2010 Hu et al. ..... 362/373
7,786,490 B2 * 8/2010 Chen ..... 257/79
7,810,954 B2 10/2010 Kolodin ..... 362/277
7,824,065 B2 11/2010 Maxik
D629,928 S 12/2010 Chen
7,884,538 B2 2/2011 Mitsuishi et al. ..... 313/502
7,976,335 B2 * 7/2011 Weber et al. ..... 439/487
8,021,025 B2 9/2011 Lee
8,235,571 B2 8/2012 Park ..... 362/555
8,253,316 B2 8/2012 Sun et al.
8,272,762 B2 9/2012 Maxik et al.
8,274,241 B2 * 9/2012 Guest et al. ..... 315/294
8,277,082 B2 10/2012 Dassanayake et al.
8,282,250 B1 10/2012 Dassanayake et al.
8,292,468 B2 10/2012 Narendran et al.
8,309,969 B2 * 11/2012 Suehiro et al. ..... 257/79
8,322,896 B2 12/2012 Falicoff et al.
8,348,470 B2 1/2013 Liu et al. ..... 362/294
8,371,722 B2 2/2013 Carroll
8,400,051 B2 3/2013 Hakata et al.
8,410,512 B2 * 4/2013 Andrews ..... 257/99
8,415,865 B2 4/2013 Liang et al.
8,421,320 B2 4/2013 Chuang
8,421,321 B2 4/2013 Chuang
8,421,322 B2 4/2013 Carroll et al.
8,449,154 B2 5/2013 Uemoto et al.
8,502,468 B2 8/2013 Li et al.
8,568,009 B2 10/2013 Chiang et al. ..... 362/563
8,641,237 B2 2/2014 Chuang
8,653,723 B2 2/2014 Cao et al.
8,696,168 B2 4/2014 Li et al.
8,740,415 B2 6/2014 Wheelock
8,750,671 B1 6/2014 Kelly et al.
8,752,984 B2 6/2014 Lenk et al.
8,760,042 B2 6/2014 Sakai et al.
2002/0047516 A1 4/2002 Iwasa et al. ..... 313/512
2003/0021113 A1 * 1/2003 Begemann ..... 362/231
2003/0038291 A1 2/2003 Cao
2004/0159846 A1 8/2004 Doxsee
2004/0201990 A1 10/2004 Neyer
2004/0223315 A1 11/2004 Suehiro et al. ..... 362/84
2005/0068776 A1 3/2005 Ge ..... 362/296
2005/0168990 A1 8/2005 Nagata et al. ..... 362/294
2005/0174780 A1 * 8/2005 Park ..... 362/294
2005/0184638 A1 8/2005 Mueller et al. ..... 313/485
2005/0242711 A1 11/2005 Bloomfield
2005/0276053 A1 12/2005 Nortrup et al. ..... 362/294
2006/0097245 A1 5/2006 Aanegola et al. ..... 257/26
2006/0097385 A1 5/2006 Negley ..... 257/722
2006/0105482 A1 5/2006 Alferink et al. ..... 438/22
2006/0138435 A1 6/2006 Tarsa et al. ..... 257/89
2006/0152140 A1 7/2006 Brandes ..... 313/503
2006/0180774 A1 8/2006 Endo ..... 250/485.1
2006/0227558 A1 10/2006 Osawa et al. ..... 362/351
2007/0090737 A1 4/2007 Hu et al. ..... 313/11
2007/0139938 A1 6/2007 Petroski
2007/0139949 A1 6/2007 Tanda et al. ..... 362/551
2007/0158668 A1 7/2007 Tarsa et al. ..... 257/98
2007/0206375 A1 9/2007 Lys
2007/0215890 A1 9/2007 Harbers et al. ..... 257/98
2007/0223219 A1 9/2007 Medendorp
2007/0263405 A1 11/2007 Ng et al. ..... 362/555
2007/0267976 A1 11/2007 Bohler et al. ..... 315/112
2007/0274080 A1 11/2007 Negley et al. ..... 362/341
2007/0285924 A1 12/2007 Morris et al. ..... 362/264
2007/0297183 A1 12/2007 Coushaine
2008/0037257 A1 * 2/2008 Bolta ..... 362/294
2008/0055908 A1 3/2008 Wu et al. ..... 362/294
2008/0062694 A1 3/2008 Lai et al. ..... 362/294
2008/0080165 A1 4/2008 Kim et al.
2008/0093615 A1 4/2008 Lin et al. ..... 257/98
2008/0106893 A1 5/2008 Johnson et al. ..... 362/228
2008/0117620 A1 5/2008 Hama et al. ..... 362/84
2008/0128735 A1 6/2008 Yoo et al.
2008/0149166 A1 6/2008 Beeson et al. ..... 136/248
2008/0173884 A1 7/2008 Chitnis et al. ..... 257/98
2008/0179611 A1 7/2008 Chitnis et al. ..... 257/98
2008/0232119 A1 * 9/2008 Ribarich ..... 362/373
2008/0285279 A1 * 11/2008 Ng et al. ..... 362/249
2008/0308825 A1 12/2008 Chakraborty et al. ..... 257/98
2009/0001399 A1 1/2009 Diana et al. ..... 257/98
2009/0015137 A1 1/2009 Su et al. ..... 313/503
2009/0040760 A1 2/2009 Chen et al. ..... 362/249
2009/0046473 A1 2/2009 Tsai et al. ..... 362/373
2009/0058256 A1 3/2009 Mitsuishi et al. ..... 313/487

(56) References Cited

U.S. PATENT DOCUMENTS

| | | | | |
|---|---|---|---|---|
| 2009/0059559 | A1 | 3/2009 | Pabst | |
| 2009/0086492 | A1 | 4/2009 | Meyer | |
| 2009/0095960 | A1 | 4/2009 | Murayama | 257/79 |
| 2009/0101930 | A1 | 4/2009 | Li | |
| 2009/0103293 | A1 | 4/2009 | Harbers et al. | |
| 2009/0103296 | A1 | 4/2009 | Harbers et al. | |
| 2009/0113296 | A1 | 4/2009 | Harbers et al. | |
| 2009/0116217 | A1 | 5/2009 | Teng et al. | |
| 2009/0122541 | A1* | 5/2009 | Suehiro et al. | 362/235 |
| 2009/0175041 | A1 | 7/2009 | Yuen et al. | |
| 2009/0184618 | A1 | 7/2009 | Hakata et al. | |
| 2009/0190353 | A1 | 7/2009 | Barker | 362/249 |
| 2009/0195186 | A1 | 8/2009 | Guest et al. | 315/294 |
| 2009/0201679 | A1 | 8/2009 | Konaka | 362/235 |
| 2009/0217970 | A1 | 9/2009 | Zimmerman et al. | 136/252 |
| 2009/0262516 | A1 | 10/2009 | Li | 362/84 |
| 2009/0273924 | A1 | 11/2009 | Chiang | 362/241 |
| 2009/0283779 | A1 | 11/2009 | Negley et al. | 257/88 |
| 2009/0296387 | A1 | 12/2009 | Reisenauer et al. | 362/235 |
| 2009/0316073 | A1 | 12/2009 | Chen et al. | 349/64 |
| 2009/0316383 | A1 | 12/2009 | Son | |
| 2009/0322197 | A1 | 12/2009 | Helbing | |
| 2009/0322208 | A1 | 12/2009 | Shaikevitch et al. | 313/503 |
| 2009/0322800 | A1 | 12/2009 | Atkins | 345/690 |
| 2009/0323333 | A1 | 12/2009 | Chang | |
| 2010/0014839 | A1 | 1/2010 | Benoy et al. | 386/117 |
| 2010/0020547 | A1 | 1/2010 | Olsson | 362/311 |
| 2010/0025700 | A1 | 2/2010 | Jung et al. | |
| 2010/0026185 | A1 | 2/2010 | Betsuda et al. | 315/32 |
| 2010/0027258 | A1 | 2/2010 | Maxik et al. | 362/240 |
| 2010/0038660 | A1 | 2/2010 | Shuja | 257/98 |
| 2010/0046231 | A1 | 2/2010 | Medinis | 362/294 |
| 2010/0060144 | A1 | 3/2010 | Justel et al. | 313/503 |
| 2010/0091487 | A1 | 4/2010 | Shin | 362/235 |
| 2010/0096967 | A1 | 4/2010 | Marinus et al. | 313/46 |
| 2010/0102707 | A1 | 4/2010 | Fukuda et al. | 313/503 |
| 2010/0134047 | A1 | 6/2010 | Hasnain | |
| 2010/0140655 | A1 | 6/2010 | Shi | 257/99 |
| 2010/0149783 | A1 | 6/2010 | Takenaka et al. | 362/84 |
| 2010/0149814 | A1 | 6/2010 | Zhai et al. | 257/88 |
| 2010/0155763 | A1 | 6/2010 | Donofrio | |
| 2010/0170075 | A1 | 7/2010 | Kanade et al. | 29/428 |
| 2010/0177522 | A1* | 7/2010 | Lee | 362/373 |
| 2010/0201284 | A1 | 8/2010 | Kraus | |
| 2010/0207502 | A1* | 8/2010 | Cao et al. | 313/46 |
| 2010/0219735 | A1 | 9/2010 | Sakai et al. | 313/46 |
| 2010/0232134 | A1 | 9/2010 | Tran | 362/84 |
| 2010/0264799 | A1* | 10/2010 | Liu et al. | 313/46 |
| 2010/0264800 | A1* | 10/2010 | Liu et al. | 313/46 |
| 2010/0314985 | A1 | 12/2010 | Premysler | 313/46 |
| 2010/0327745 | A1 | 12/2010 | Dassanayake et al. | |
| 2010/0328925 | A1 | 12/2010 | Hoelen et al. | 362/84 |
| 2011/0037368 | A1 | 2/2011 | Huang | 313/46 |
| 2011/0074271 | A1* | 3/2011 | Takeshi et al. | 313/46 |
| 2011/0074296 | A1* | 3/2011 | Shen et al. | 315/112 |
| 2011/0080096 | A1 | 4/2011 | Dudik et al. | 315/112 |
| 2011/0080740 | A1 | 4/2011 | Allen et al. | 362/294 |
| 2011/0089804 | A1* | 4/2011 | Mahalingam et al. | 313/46 |
| 2011/0089830 | A1 | 4/2011 | Pickard et al. | 315/32 |
| 2011/0095686 | A1 | 4/2011 | Falicoff et al. | 315/35 |
| 2011/0133222 | A1 | 6/2011 | Allen et al. | 257/88 |
| 2011/0175528 | A1 | 7/2011 | Rains et al. | 315/51 |
| 2011/0176316 | A1 | 7/2011 | Phipps et al. | |
| 2011/0205733 | A1 | 8/2011 | Lenderink et al. | 362/231 |
| 2011/0215696 | A1* | 9/2011 | Tong et al. | 313/46 |
| 2011/0216523 | A1 | 9/2011 | Tong et al. | 362/84 |
| 2011/0242816 | A1 | 10/2011 | Chowdhury et al. | 362/294 |
| 2011/0267835 | A1 | 11/2011 | Boonekamp et al. | 362/555 |
| 2011/0273072 | A1* | 11/2011 | Oki | 313/46 |
| 2011/0298371 | A1* | 12/2011 | Brandes et al. | 315/32 |
| 2012/0020092 | A1* | 1/2012 | Bailey | 362/311.02 |
| 2012/0040585 | A1 | 2/2012 | Huang | |
| 2012/0155059 | A1* | 6/2012 | Hoelen et al. | 362/84 |
| 2012/0161626 | A1* | 6/2012 | van de Ven et al. | 315/35 |
| 2012/0320591 | A1* | 12/2012 | Liao et al. | 362/249.02 |
| 2013/0049018 | A1* | 2/2013 | Ramer et al. | 257/81 |
| 2013/0063945 | A1* | 3/2013 | Wu et al. | 362/249.02 |
| 2013/0114253 | A1* | 5/2013 | Segawa et al. | 362/235 |
| 2013/0249374 | A1* | 9/2013 | Le et al. | 313/12 |

FOREIGN PATENT DOCUMENTS

| | | | |
|---|---|---|---|
| CN | 1802533 | | 7/2006 |
| CN | 101262032 | | 9/2008 |
| CN | 1013388887 | A | 1/2009 |
| CN | 101641623 | | 2/2010 |
| DE | 4311937 | A1 | 10/1994 |
| DE | 10251955 | A1 | 5/2004 |
| DE | 102004051382 | | 4/2006 |
| DE | 102006061164 | | 6/2008 |
| DE | 10 2007 037862 | A1 | 10/2008 |
| DE | 202008013667 | | 12/2008 |
| DE | 102011004718 | | 8/2012 |
| EP | 0876085 | | 11/1998 |
| EP | 0876085 | A2 | 11/1998 |
| EP | 0890059 | A1 | 1/1999 |
| EP | 0936682 | A1 | 8/1999 |
| EP | 1058221 | A2 | 12/2000 |
| EP | 1881259 | | 1/2008 |
| EP | 2146135 | A2 | 1/2010 |
| EP | 2154420 | | 2/2010 |
| EP | 2469154 | | 6/2012 |
| FR | 2941346 | | 7/2010 |
| GB | 1423011 | | 1/1976 |
| GB | 2345954 | A | 7/2000 |
| GB | 2 366 610 | A | 3/2002 |
| GB | 2366610 | | 3/2002 |
| GB | 2366610 | A | 3/2002 |
| JP | H03081903 | | 4/1991 |
| JP | H06283006 | | 10/1994 |
| JP | H09265807 | | 10/1997 |
| JP | H11177149 | | 7/1999 |
| JP | 11-213730 | A | 8/1999 |
| JP | H11260125 | | 9/1999 |
| JP | 2000022222 | | 1/2000 |
| JP | 2000173304 | | 6/2000 |
| JP | 2001118403 | | 4/2001 |
| JP | 2003515899 | | 5/2003 |
| JP | 2004146225 | | 5/2004 |
| JP | 2004241318 | | 8/2004 |
| JP | 2005-093097 | A | 4/2005 |
| JP | 20051008700 | | 4/2005 |
| JP | 2005244226 | | 9/2005 |
| JP | 2005-286267 | A | 10/2005 |
| JP | 2005277127 | | 10/2005 |
| JP | 2006019676 | | 1/2006 |
| JP | 2006108661 | | 4/2006 |
| JP | 2006148147 | | 6/2006 |
| JP | 2006156187 | | 6/2006 |
| JP | 20066159187 | | 6/2006 |
| JP | WO 2006065558 | | 6/2006 |
| JP | 200640850 | A | 9/2006 |
| JP | 2006525648 | | 11/2006 |
| JP | 2006331683 | | 12/2006 |
| JP | 200759930 | | 3/2007 |
| JP | 2007059911 | | 3/2007 |
| JP | 3138653 | | 12/2007 |
| JP | 2008505448 | | 2/2008 |
| JP | 2008091140 | | 4/2008 |
| JP | 2008108835 | | 5/2008 |
| JP | 2008523639 | | 7/2008 |
| JP | 2008187195 | | 8/2008 |
| JP | 2008262765 | | 10/2008 |
| JP | 200828183 | | 11/2008 |
| JP | 2008288409 | | 11/2008 |
| JP | 2008300117 | | 12/2008 |
| JP | 2008300203 | | 12/2008 |
| JP | 2008300570 | | 12/2008 |
| JP | 2009-016058 | A | 1/2009 |
| JP | 2009016058 | | 1/2009 |
| JP | 2009016153 | | 1/2009 |
| JP | 2009021264 | | 1/2009 |
| JP | 2009117346 | | 5/2009 |
| JP | WO 2009093163 | | 7/2009 |

(56) References Cited

FOREIGN PATENT DOCUMENTS

| | | | |
|---|---|---|---|
| JP | U3153766 | | 8/2009 |
| JP | WO 2009119038 | | 10/2009 |
| JP | 2009266780 | | 11/2009 |
| JP | 2009277586 | | 11/2009 |
| JP | 2009295299 | | 12/2009 |
| JP | 2010016223 | | 1/2010 |
| JP | 2010040494 | | 2/2010 |
| JP | 2010050473 | | 3/2010 |
| JP | 2010129300 | | 6/2010 |
| JP | 2010267826 | | 11/2010 |
| KR | 100944181 | | 2/2010 |
| KR | 1020100037353 | | 4/2010 |
| KR | 100980588 | B1 | 9/2010 |
| KR | 3020110008445 | | 3/2011 |
| TW | D134005 | | 3/2010 |
| TW | 100300960 | | 3/2011 |
| TW | D141681 | | 7/2011 |
| WO | WO 00/17569 | A1 | 3/2000 |
| WO | WO 0124583 | A1 | 4/2001 |
| WO | WO 01/40702 | A1 | 6/2001 |
| WO | WO 0160119 | A2 | 8/2001 |
| WO | WO 2004100213 | | 11/2004 |
| WO | WO 2004100213 | A2 | 11/2004 |
| WO | WO 2005107420 | A2 | 11/2005 |
| WO | WO 2006059535 | A2 | 6/2006 |
| WO | WO 2006065558 | | 6/2006 |
| WO | WO 2007/130358 | A2 | 11/2007 |
| WO | WO 2007146566 | A2 | 12/2007 |
| WO | WO 2008/018002 | A2 | 2/2008 |
| WO | WO 2008018002 | | 2/2008 |
| WO | WO 2008/052318 | A1 | 5/2008 |
| WO | WO 2008/117211 | A1 | 10/2008 |
| WO | WO 2008134056 | A1 | 11/2008 |
| WO | WO 2008/146229 | A2 | 12/2008 |
| WO | WO 2008146229 | | 12/2008 |
| WO | WO 2009/024952 | A2 | 2/2009 |
| WO | WO 2009052099 | | 4/2009 |
| WO | 2009091562 | | 7/2009 |
| WO | WO 2009/091562 | A2 | 7/2009 |
| WO | WO 2009/093163 | A2 | 7/2009 |
| WO | WO 2009093163 | | 7/2009 |
| WO | WO 2009093163 | A2 | 7/2009 |
| WO | WO 2009/107052 | A1 | 9/2009 |
| WO | WO 2009107052 | | 9/2009 |
| WO | 2009119038 | | 10/2009 |
| WO | WO 2009/119038 | A2 | 10/2009 |
| WO | WO 2009/128004 | A1 | 10/2009 |
| WO | WO 2009119038 | | 10/2009 |
| WO | WO 2009125314 | A2 | 10/2009 |
| WO | WO 2009131627 | | 10/2009 |
| WO | WO 2009143047 | A2 | 11/2009 |
| WO | 2009158422 | | 12/2009 |
| WO | WO 2009/158422 | A1 | 12/2009 |
| WO | WO 2009148543 | | 12/2009 |
| WO | WO 2009158422 | A1 | 12/2009 |
| WO | WO 2010/012999 | A2 | 2/2010 |
| WO | WO 2010012999 | | 2/2010 |
| WO | WO 2010013893 | | 2/2010 |
| WO | WO 2010052640 | | 5/2010 |
| WO | WO 2010/119618 | A1 | 10/2010 |
| WO | WO 2010/128419 | A1 | 11/2010 |
| WO | WO 2011100193 | | 8/2011 |
| WO | 2011109098 | | 9/2011 |
| WO | WO 2011109091 | A1 | 9/2011 |
| WO | WO 2012011279 | | 1/2012 |
| WO | WO 2012031533 | | 3/2012 |

OTHER PUBLICATIONS

Office Action of the IPO for Taiwan Patent Application No. TW 100300961 issued Nov. 16, 2011.
Office Action of the IPO for Taiwan Patent Application No. TW 100300960 issued Nov. 15, 2011.
Office Action of the IPO for Taiwan Patent Application No. TW 100302770 issued Jan. 13, 2012.
International Search Report and Written Opinion for PCT Patent Application No. PCT/US2011/000405 mailed Nov. 2, 2011.
International Search Report and Written Opinion for PCT/US2011/000407 mailed Nov. 16, 2011.
International Search Report and Written Opinion from PCT Application No. PCT/US2011/000389, dated May 6, 2013.
International Search Report and Written Opinion from PCT Application No. PCT/US2011/000390, dated May 6, 2013.
International Preliminary Report on Patentability from PCT/US2011/00389, dated May 8, 2013.
International Preliminary Report on Patentability from PCT/US2011/000390, dated May 8, 2013.
Reasons for Rejection from Japanese Patent Appl. No. 2011-198454, dated Mar. 7, 2013.
Notice to Submit a Response from Korean Patent Application No. 30-2011-0008448, dated Apr. 16, 2012.
Notice to Submit a Response from Korean Patent Application No. 30-2011-0008445, dated Apr. 16, 2012.
Notice to Submit a Response from Korean Patent Application No. 30-2011-0008446, dated Apr. 16, 2012.
Office Action for Taiwanese Patent Application No. 100300961, dated May 7, 2012.
Office Action from Taiwanese Patent Application No. 100300960, dated May 7, 2012.
Notice to Submit a Response from Korean Design Patent Application No. 30-2011-0024961, dated Sep. 10, 2012.
International Search Report and Written Opinion from PCT Application No. PCT/US2012/044705 dated Oct. 9, 2012.
Notice to Submit a Response from Korean Patent Application No. 30-2011-0008446, dated Oct. 22, 2012.
Office Action from U.S. Appl. No. 13/028,946, dated Jul. 16, 2012.
Response to OA from U.S. Appl. No. 13/028,946, filed Oct. 8, 2012.
Office Action from U.S. Appl. No. 13/029,025, dated Jul. 16, 2013.
Office Action from U.S. Appl. No. 13/430,478, dated Jun. 18, 2013.
Office Action from U.S. Appl. No. 12/901,405, dated Jul. 1, 2013.
Office Action from U.S. Appl. No. 13/018,291, dated Oct. 10, 2012.
Response to OA from U.S. Appl. No. 13/018,291, filed Jan. 7, 2013.
Office Action from U.S. Appl. No. 13/022,490, dated Nov. 7, 2012.
Response to OA from U.S. Appl. No. 13/022,490, filed Feb. 1, 2013.
Office Action from U.S. Appl. No. 13/034,501, dated Dec. 3, 2012.
Response to OA from U.S. Appl. No. 13/034,501, filed Apr. 3, 2013.
Office Action from U.S. Appl. No. 13/028,946, dated Dec. 4, 2012.
Response to OA from U.S. Appl. No. 13/028,946, filed Jan. 29, 2013.
Office Action from U.S. Appl. No. 13/029,005, dated Jan. 24, 2013.
Office Action from U.S. Appl. No. 12/901,405, dated Jan. 9, 2013.
Response to OA from U.S. Appl. No. 12/901,405, filed Apr. 29, 2013.
Office Action from U.S. Appl. No. 12/985,275, dated Feb. 28, 2013.
Response to OA from U.S. Appl. No. 12/985,275, filed May 28, 2013.
Office Action from U.S. Appl. No. 13/018,291, dated Mar. 20, 2013.
Response to OA from U.S. Appl. No. 13/018,291, filed May 20, 2013.
Office Action from U.S. Appl. No. 13/022,490, dated Apr. 2, 2013.
Office Action from U.S. Appl. No. 13/018,291, dated May 31, 2013.
Office Action from U.S. Appl. No. 12/636,958, dated Jul. 19, 2012.
Response to OA from U.S. Appl. No. 12/636,958, filed Nov. 19, 2012.
Office Action from U.S. Appl. No. 13/054,501, dated May 31, 2013.
Office Action from U.S. Appl. No. 13/028,946, filed Apr. 11, 2013.
Office Action from U.S. Appl. No. 13/028,913, dated Apr. 29, 2013.
Office Action from U.S. Appl. No. 13/029,005, dated Jan. 4, 2013.
Response to OA from U.S. Appl. No. 13/029,005, filed Apr. 17, 2013.
Office Action from U.S. Appl. No. 12/848,825, dated Nov. 5, 2012.
Response to CA from U.S. Appl. No. 12/848,825, filed Feb. 5, 2013.
Office Action from U.S. Appl. No. 13/029,005, dated Jun. 11, 2013.
Search Report and Written Opinion from PCT Application No. PCT/US2012/072108, dated Feb. 27, 2013.
U.S. Appl. No. 13/018,245, filed Jan. 31, 2011, Tong.
U.S. Appl. No. 12/901,405, filed Oct. 8, 2010, Tong.
U.S. Appl. No. 61/339,515, filed Mar. 3, 2010, Tong.
U.S. Appl. No. 12/848,825, filed Aug. 2, 2010, Tong.
U.S. Appl. No. 12/975,820, Van de Ven.
U.S. Appl. No. 13/029,063, filed Feb. 16, 2011, Hussell.
U.S. Appl. No. 61/435,759, filed Jan. 24, 2011 Le.
U.S Appl. No. 61/339,516, filed Mar. 3, 2010 Tong.

(56) References Cited

OTHER PUBLICATIONS

U.S. Appl. No. 61/424,670, filed Dec. 19, 2010, Zongjie Yuan.
Cree, XLamp® LEDs. Product Info and Data Sheets. 34 Pages.
Nichia Corp Part Spec, *High Brightness LEDs*, (May 1999), 15 pgs.
EA, (NSPW 300BS. NSPW 312BS, Etc).
U.S. Appl. No. 13/022,490, Feb. 7, 2011, Tong.
U.S. Appl. No. 11/656,759, filed Jan. 22, 2007, entitled "Wafer Level Phosphor Coating Method and Devices Fabricated Utilizing Method", to Chitnis et al.
U.S. Appl. No. 11/899,790, filed Sep. 7, 2007, entitled "Wafer Level Phosphor Coating Method and Devices Fabricated Utilizing Method", to Chitnis et al.
U.S. Appl. No. 11/473,089, filed Jun. 21, 2006, entitled "Close Loopelectrophoretic Deposition of Semiconductor Devices", to Tarsa et al.
C. Crane Company, GeoBulb®—II LED Light Bulb, Data Sheet dated Aug. 18, 2010, available at http://www.ccrane.com/lights/led-light-bulbs/geobulb-led-light-bulb.aspx.
Cree LR4, Recessed architectural Downlight data sheet, dated Aug. 18, 2010, available at http:..ledtheway.com/store/item/37ug9/Cree_LED_Lighting/Cree_LR4_4_Recessed_Architectural . . . .
Cree LR6, Recessed Downlight Module data sheet, dated Aug. 18, 2010, available at https:..ledtheway.com/storo/item/37ug8/Cree_LED_Lighting/Cree_LR6_6_Recessed_Downlight_Mo . . . .
Patent Abstracts of Japan, Publication No. 2006040850, Date: Sep. 2, 2006.
PCT International Search Report and Written Opinion, Application No. PCT/US2009/063804, dated: Feb. 26, 2010.
U.S. Appl. No. 12/566,195, Van De Ven, filed Sep. 24, 2009.
U.S. Appl. No. 12/704,730, Van De Ven, filed Feb. 12, 2010.
International Search Report and Written Opinion for PCT/US2011/000403 mailed Aug. 23, 2011.
International Search Report and Written Opinion for PCT/US2011/000404 mailed Aug. 25, 2011.
International Search Report and Written Opinion for PCT/US2011/000398 mailed Aug. 30, 2011.
International Search Report and Written Opinion for PCT/US2011/000406 mailed Sep. 15, 2011.
International Search Report and Written Opinion for counterpart PCT Application No. PCT/US2011/000397 mailed May 24, 2011.
International Search Report and Written Opinion for PCT Application No. PCT/US2010/003146 mailed Jun. 7, 2011.
Decision for Final Rejection for Japanese Patent Application No. 2001-542133 mailed Jun. 28, 2011.
International Search Report and Written Opinion for PCT/US2011/000400 mailed May 2, 2011.
International Search Report and Written Opinion for PCT Application No. PCT/US2011/000391 mailed Oct. 6, 2011.
International Search Report and Written Opinion for PCT Application No. PCT/US2011/000402 mailed Sep. 30, 2011.
International Search Report and Written Opinion for PCT Application No. PCT/US2011/000399 mailed Jul. 12, 2011.
Decision to Refuse a European Patent Application for EP 09 152 962.8 dated Jul. 6, 2011.
Office Action from U.S. Appl. No. 13/022,490, dated Oct. 17, 2013.
Office Action from U.S. Appl. No. 11/149,999, dated May 13, 2013.
Response to OA from U.S. Appl. No. 11/149,999, filed Sep. 13, 2013.
Office Action from U.S. Appl. No. 12/985,275, dated Aug. 27, 2013.
Office Action from U.S. Appl. No. 13/028,863, dated Jul. 30, 2013.
Decision of Dismissal of Amendment, Decision of Rejection from Japanese Patent Appl. No. 2011-231319, dated Oct. 15, 2013.
Office Action from Japanese Patent Appl. No. 2012-556063, dated Oct. 11, 2013.
Office Action from Japanese Patent Appl. No. 2012-556066, dated Oct. 25, 2013.
Office Action from Japanese Patent Appl. No. 2012-556065, dated Oct. 25, 2013.
Office Action from U.S. Appl. No. 13/028,913, dated Nov. 4, 2013.
Office Action from Japanese Patent Appl. No. 2012-556064. dated Oct. 29, 2013.
Office Action from U.S. Appl. No. 13/029,063, dated Oct. 23, 2013.
Office Action from U.S. Appl. No. 13/028,946, dated Oct. 31, 2013.
Office Action from U.S. Appl. No. 13/029,068, dated Nov. 15, 2013.
Office Action from U.S. Appl. No. 13/029,025, dated Dec. 6, 2013.
Notice of Reasons for Rejection from Japanese Patent Appl. No. 2012-543086, dated Aug. 27, 2013.
Notice of Reasons for Rejection from Japanese Patent Appl. No. 2012-543086, dated Dec. 24, 2013.
Office Action from Japanese Patent Appl. No. 2012-556062, dated Dec. 20, 2013.
International Preliminary Report on Patentability and Written Opinion from PCT/US2012/044705 dated Jan. 7, 2019.
First Office Action from Chinese Patent Appl. No. 201080062056.X, dated Feb. 12, 2014.
Office Action from U.S. Appl. No. 13/028,913, dated Feb. 19, 2014.
Office Action from U.S. Appl. No. 13/028,863, dated Mar. 4, 2014.
Office Action from U.S. Appl. No. 13/430,476, dated Feb. 21, 2014.
Office Action from U.S. Appl. No. 13/018,291, dated Mar. 7, 2014.
Office Action from U.S. Appl. No. 13/029,025, dated Mar. 19, 2014.
Office Action from U.S. Appl. No. 13/029,063, dated Apr. 1, 2014.
Office Action from U.S. Appl. No. 12/985,275, dated Apr. 10, 2014.
Office Action from U.S. Appl. No. 13/029,068, dated Apr. 24, 2014.
Office Action from U.S. Appl. No. 13/034,501, dated May 5, 2014.
Office Action from U.S. Appl. No. 13/022,490, dated May 6, 2014.
Office Action from U.S. Appl. No. 13/028,863, dated May 9, 2014.
Office Action from Japanese Patent appl. No. 2012-556063, dated Jan. 28, 2014.
Comments on the Written Opinion and Amendment of the Application from European Patent appl. No. 12740244.4, dated Feb. 20, 2014.
International Search Report and Written Opinion from PCT/US2013/057712 dated Feb. 4, 2014.
Office Action from U.S. Appl. No. 11/149,999, dated Jan. 15, 2014.
Office Action from U.S. Appl. No. 13/034,501, dated Jan. 23, 2014.
Office Action from Japanese Patent Appl. No. 2012-556066, dated Mar. 14, 2014.
Office Action from U.S. Appl. No. 13/029,068, dated Jun. 13, 2014.
Office Action from U.S. Appl. No. 13/018,245, dated Jun. 10, 2014.
Decision to Grant from Japanese Patent Appl. No. 2012-556066, dated Jul. 4, 2014.
Decision of Rejection from Japanese Patent Appl. No. 2012-556064, dated Jun. 6, 2014.
First Office Action from Chinese Patent Application No. 2011800207069, dated May 5, 2014.
First Office Action from Chinese Patent Application No. 201180022606, dated May 4, 2014.
First Office Action from Chinese Patent Appl. No. 201180020709.2, dated May 4, 2014.
Office Action from U.S. Appl. No. 13/028,946, dated May 27, 2014.
Office Action from U.S. Appl. No. 13/028,913, dated May 22, 2014.
First Office Action and Search Report from Chinese Patent Appl. No. 201180022620X, dated Jul. 1, 2014.
Office Action from U.S. Appl. No. 13/340,478, dated Jul. 23, 2014.
Office Action from U.S. Appl. No. 14/014,272, dated Jul. 29, 2014.
Office Action from U.S. Appl. No. 13/029,025, dated Aug. 6, 2014.
Office Action from U.S. Appl. No. 12/985,275, dated Aug. 7, 2014.
Office Action from U.S. Appl. No. 12/901,405, dated Aug. 7, 2014.
First Office Action from Chinese Patent Appl. No. 2011800223856, dated Aug. 1, 2014.
First Office Action from Chinese Patent Appl. No. 2011800226248, dated Aug. 25, 2014.
Official Action from European Patent Appl. No. 11710348.1-1757, dated Oct. 9, 2014.
Office Action from Japanese Patent Appl. No. 2012-556065, dated Aug. 5, 2014.
Office Action from Japanese Patent Appl. No. 2012-556062, dated Aug. 5, 2014.
First Office Action from Chinese Patent Appl. No. 2011800223837, dated Jul. 24, 2014.
Office Action from European Patent Appl. No. 11710906.6-1757, dated Sep. 10, 2014.
First Office Action from Chinese Appl. No. 201180022626.7. dated Nov. 15, 2014.

(56) References Cited

OTHER PUBLICATIONS

Second Office Action from Chinese Appl. No. 201180022606X, dated Dec. 23, 2014.
Appeal Decision from Japanese Appl. No. 2011-231319, dated Jan. 13, 2015.
Office Action from U.S. Appl. No. 13/607,300, dated Nov. 19, 2014.
Office Action from U.S. Appl. No. 13/029,025, dated Dec. 11, 2014.
Office Action from U.S. Appl. No. 13/018,245, dated Dec. 11, 2014.
Office Action from U.S. Appl. No. 13/029,068, dated Dec. 23, 2014.
Office Action from U.S. Appl. No. 12/985,275, dated Dec. 29, 2014.
Office Action from U.S. Appl. No. 13/029,068, dated Sep. 26, 2014.
Response to OA from U.S. Appl. No. 13/029,068, filed Nov. 18, 2014.
Office Action from U.S. Appl. No. 13/430,478, dated Nov. 5, 2014.
Office Action from U.S. Appl. No. 13/034,501, dated Nov. 5, 2014.
Office Action from U.S. Appl. No. 13/028,863, dated Nov. 10, 2014.
Decision to Grant from Japanese Appl. No. 2012-556062, dated Nov. 27, 2014.
Second Office Action from Chinese Patent Appl. No. 2011800207069, dated Dec. 5, 2014.
Second Office Action from Chinese Appl. No. 201000062056.X, dated Sep. 29, 2014.
First Office Action and Search Report from Chinese Appl. No. 2011800223856, dated Aug. 1, 2014.
Communication from European Appl. No. 12816621.2-1757, dated Sep. 25, 2014.
Pretrial Report from Japanese Patent Appl. No. 2011-231319, dated Apr. 14, 2014.
Summons to Oral Proceedings from European Patent Appl. No. 09152962/2166580, dated Jan. 29, 2015.
First Office Action from Chinese Patent Appl. No. 2011800225832, dated Jan. 20, 2015.
First Office Action from Chinese Patent Appl. No. 2011800226214, dated Dec. 25, 2014.
Second Office Action and Search Report from Chinese Patent Appl. No. 2011800207092. dated Jan. 22, 2015.
Examination Report from European Patent Appl. No. 11 710 348.1-1757, dated Feb. 18, 2015.
Examination Report from European Patent Appl. No. 11 710 906.6-1757, dated Feb. 18, 2015.
Examination Report from European Patent Appl. No. 12 740 244.4-1757, dated Feb. 9, 2015.
Office Action from U.S. Appl. No. 13/029,063, dated Jan. 13, 2015.
Office Action from U.S. Appl. No. 14/014,272, dated Jan. 14, 2015.
Response to OA from U.S. Appl. No. 14/014,272, filed Mar. 3, 2015.
Office Action from U.S. Appl. No. 12/901,405, dated Feb. 4, 2015.

* cited by examiner

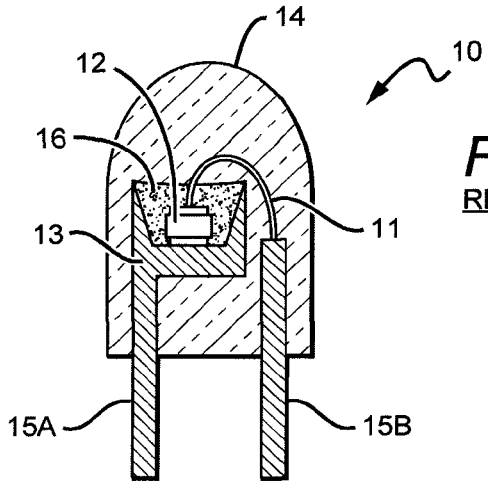
FIG. 1
RELATED ART
FIG. 2
RELATED ART
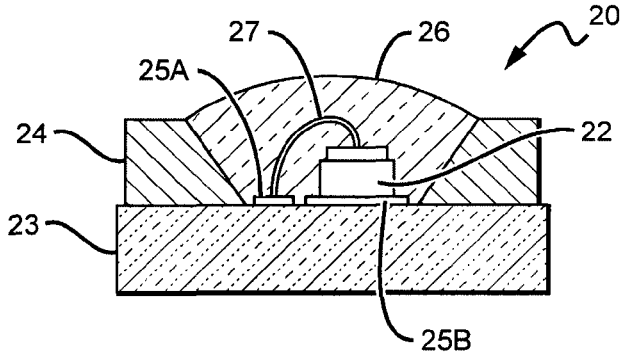
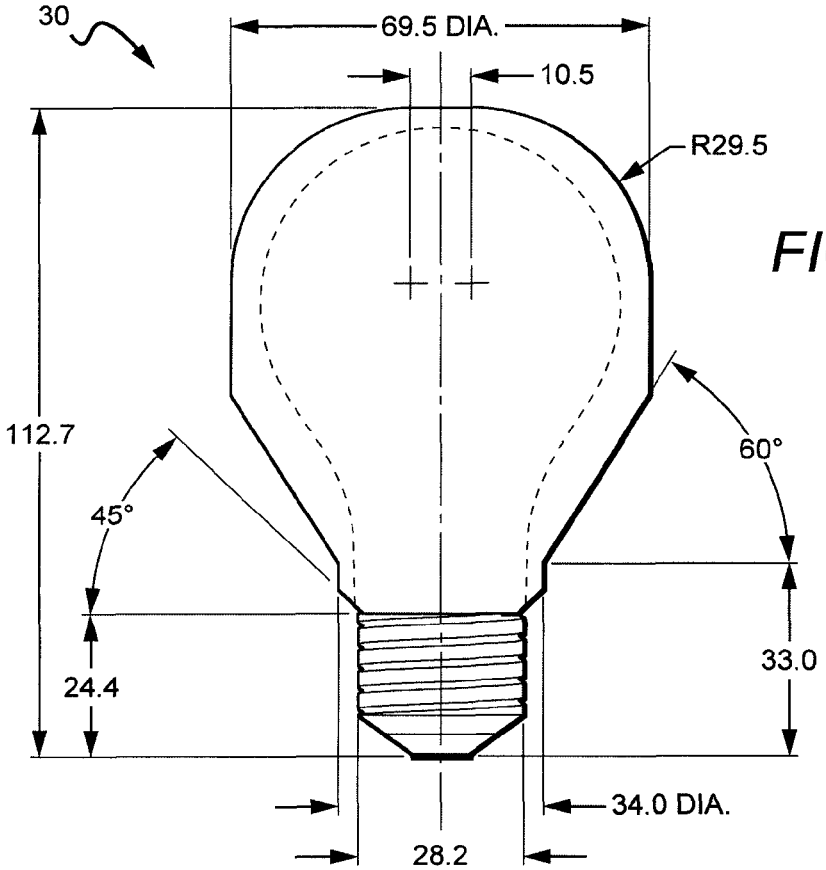
FIG. 3

FIG. 4
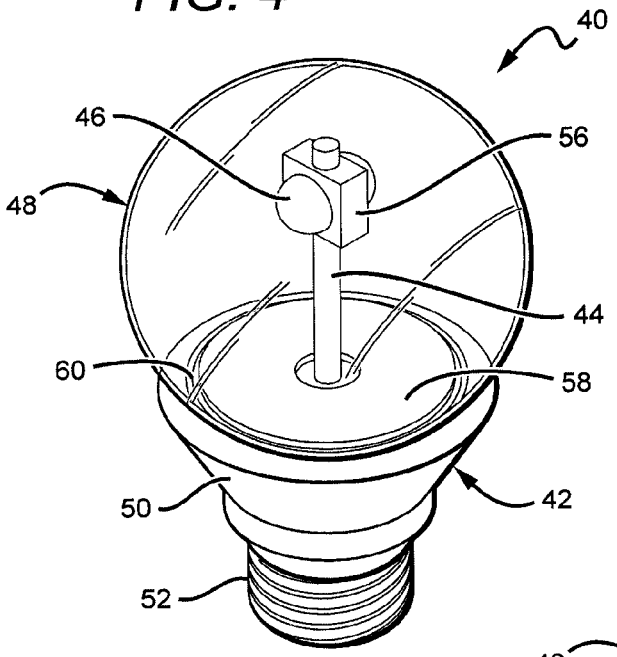
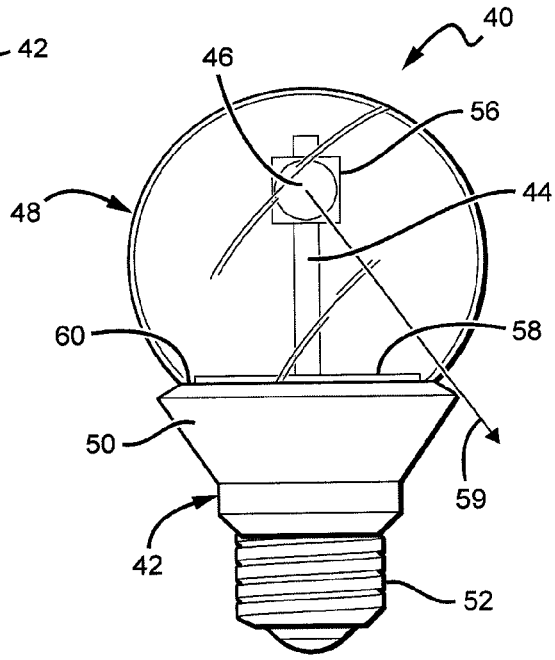
FIG. 5
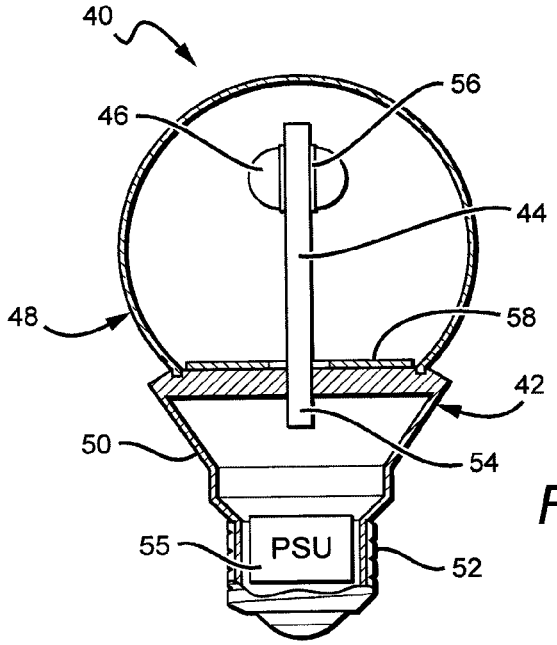
FIG. 6

FIG. 7
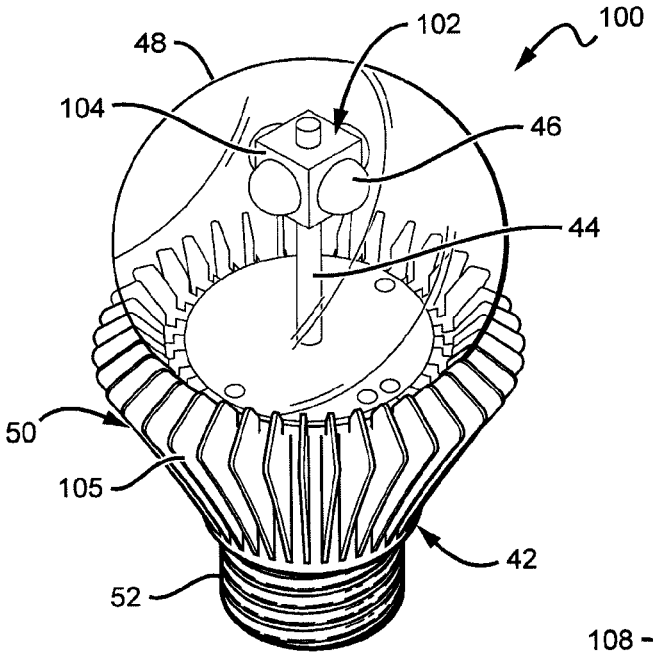
FIG. 8
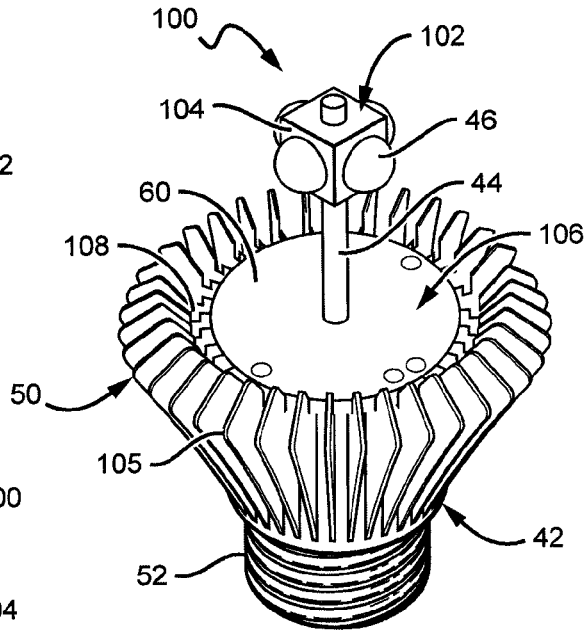
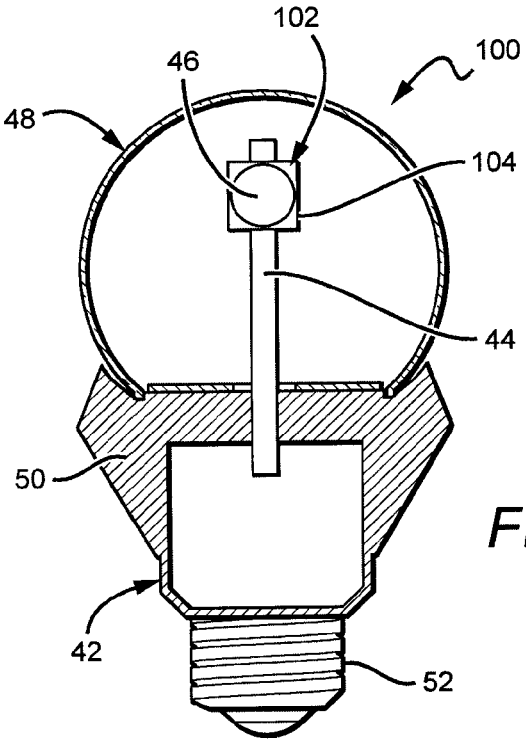
FIG. 10

FIG. 12
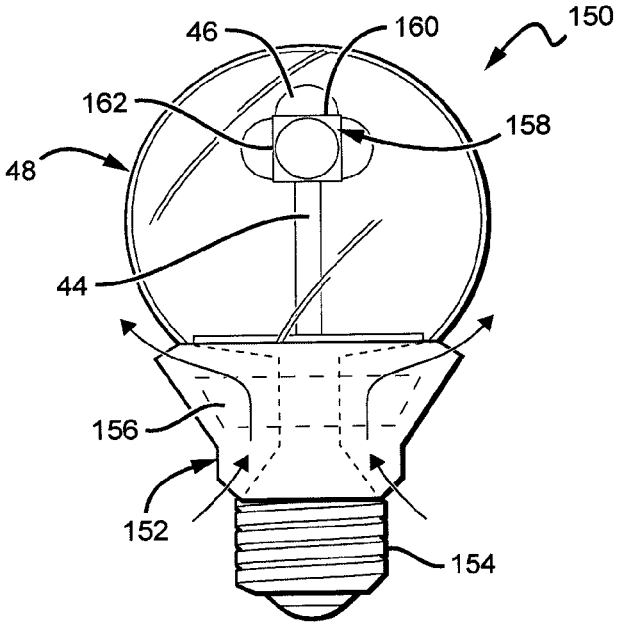
FIG. 13
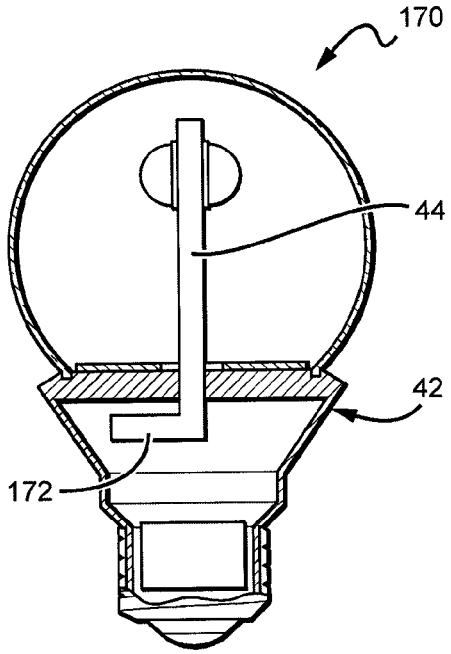
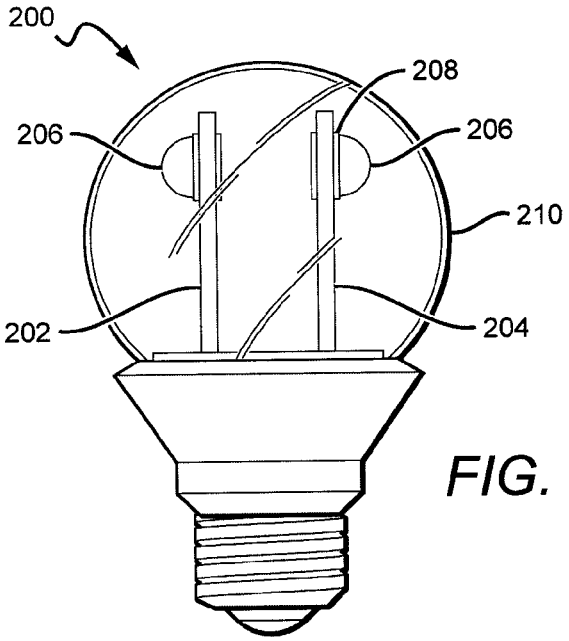
FIG. 14

LAMP STRUCTURE WITH REMOTE LED LIGHT SOURCE

BACKGROUND OF THE INVENTION

1. Field of the Invention

This invention relates to solid state lamps and bulbs and in particular to light emitting diode (LED) based lamps and bulbs capable of providing omnidirectional emission patterns similar to those of filament based light sources.

2. Description of the Related Art

Light emitting diodes (LED or LEDs) are solid state devices that convert electric energy to light, and generally comprise one or more active layers of semiconductor material sandwiched between oppositely doped layers. When a bias is applied across the doped layers, holes and electrons are injected into the active layer where they recombine to generate light. Light is emitted from the active layer and from all surfaces of the LED.

In order to use an LED chip in a circuit or other like arrangement, it is known to enclose an LED chip in a package to provide environmental and/or mechanical protection, color selection, light focusing and the like. An LED package also includes electrical leads, contacts or traces for electrically connecting the LED package to an external circuit. In a typical LED package 10 illustrated in FIG. 1, a single LED chip 12 is mounted on a reflective cup 13 by means of a solder bond or conductive epoxy. One or more wire bonds 11 connect the ohmic contacts of the LED chip 12 to leads 15A and/or 15B, which may be attached to or integral with the reflective cup 13. The reflective cup may be filled with an encapsulant material 16 which may contain a wavelength conversion material such as a phosphor. Light emitted by the LED at a first wavelength may be absorbed by the phosphor, which may responsively emit light at a second wavelength. The entire assembly is then encapsulated in a clear protective resin 14, which may be molded in the shape of a lens to collimate the light emitted from the LED chip 12. While the reflective cup 13 may direct light in an upward direction, optical losses may occur when the light is reflected (i.e. some light may be absorbed by the reflector cup due to the less than 100% reflectivity of practical reflector surfaces). In addition, heat retention may be an issue for a package such as the package 10 shown in FIG. 1, since it may be difficult to extract heat through the leads 15A, 15B.

A conventional LED package 20 illustrated in FIG. 2 may be more suited for high power operations which may generate more heat. In the LED package 20, one or more LED chips 22 are mounted onto a carrier such as a printed circuit board (PCB) carrier, substrate or submount 23. A metal reflector 24 mounted on the submount 23 surrounds the LED chip(s) 22 and reflects light emitted by the LED chips 22 away from the package 20. The reflector 24 also provides mechanical protection to the LED chips 22. One or more wirebond connections 11 are made between ohmic contacts on the LED chips 22 and electrical traces 25A, 25B on the submount 23. The mounted LED chips 22 are then covered with an encapsulant 26, which may provide environmental and mechanical protection to the chips while also acting as a lens. The metal reflector 24 is typically attached to the carrier by means of a solder or epoxy bond.

LED chips, such as those found in the LED package 20 of FIG. 2 can be coated by conversion material comprising one or more phosphors, with the phosphors absorbing at least some of the LED light. The LED chip can emit a different wavelength of light such that it emits a combination of light from the LED and the phosphor. The LED chip(s) can be coated with a phosphor using many different methods, with one suitable method being described in U.S. patent applications Ser. Nos. 11/656,759 and 11/899,790, both to Chitnis et al. and both entitled "Wafer Level Phosphor Coating Method and Devices Fabricated Utilizing Method". Alternatively, the LEDs can be coated using other methods such as electrophoretic deposition (EPD), with a suitable EPD method described in U.S. patent application Ser. No. 11/473,089 to Tarsa et al. entitled "Close Loop Electrophoretic Deposition of Semiconductor Devices".

Lamps have been developed utilizing solid state light sources, such as LEDs, with a conversion material that is separated from or remote to the LEDs. Such arrangements are disclosed in U.S. Pat. No. 6,350,041 to Tarsa et al., entitled "High Output Radial Dispersing Lamp Using a Solid State Light Source." The lamps described in this patent can comprise a solid state light source that transmits light through a separator to a disperser having a phosphor. The disperser can disperse the light in a desired pattern and/or changes its color by converting at least some of the light through a phosphor. In some embodiments, the separator spaces the light source a sufficient distance from the disperser such that heat from the light source will not transfer to the disperser when the light source is carrying elevated currents necessary for room illumination.

Different LED based bulbs have been developed that utilize large numbers of low brightness LEDs (e.g. 5 mm LEDs) mounted to a three-dimensional surface to achieve wide-angle illumination. These designs, however, do not provide optimized omnidirectional emission that falls within standard uniformity requirements. These bulbs also contain a large number of interconnected LEDs making them prohibitively complex, expensive and unreliable. This makes these LED bulbs generally impractical for most illumination purposes.

Other LED bulbs have also been developed that use a mesa-type design for the light source with one LED on the top surface and seven more on the sidewalls of the mesa. (see GeoBulb®-II provided by C. Crane). This arrangement, however, does not provide omnidirectional emission patterns, but instead provides a pattern that is substantially forward biased. The mesa for this bulb also comprises a hollow shell, which can limit its ability to thermally dissipate heat from the emitters. This can limit the drive current that can be applied to the LEDs. This design is also relatively complex, using several LEDs, and not compatible with large volume manufacturing of low-cost LED bulbs.

SUMMARY OF THE INVENTION

The present invention provides various embodiments of solid state lamps and bulbs that are efficient, reliable and cost effective and can be arranged to provide omnidirectional emission patterns. The different embodiments comprise elements to elevate the solid state light source(s) above the lamp base, with the elevating element also being thermally conductive to conduct heat from the light source to the lamp base. The elevating element can comprise many different materials or devices arranged in different ways, with some lamps comprising heat pipe elevating elements.

One embodiment of solid state lamp according to the present invention comprises a solid state light source and a lamp base at least partially comprising a heat conductive material. An elongated elevating element is mounted to the lamp with the light source mounted to the elevating element such that the LEDs are above the lamp base, with the elevating element being at least partially heat conductive. A diffuser is also included to diffuse light emitting from lamp into the desired emission pattern.

One embodiment of a light emitting diode based bulb according to the present invention comprises a heat pipe and a plurality of light emitting diodes, each of which is mounted at or near a first end of, and in thermal contact with, the heat pipe. The heat pipe comprises a thermally conductive path to conduct heat away from the light emitting diodes. A lamp base is included that at least partially comprises a heat conductive material. The second end of the heat pipe is mounted to, and in thermal contact with, the heat pipe, with the lamp base comprising a thermally conductive path to conduct heat away from the heat pipe.

Another embodiment of a solid state lamp according to the present invention comprises a heat pipe having a plurality of solid state light sources in thermal contact with the heat pipe. A heat sink structure is included with the heat pipe thermally coupled to the heat sink structure. Heat from the solid state light sources conducts to the heat sink structure through the heat pipe. A diffuser is arranged with at least some light from the light sources passing through the diffuser.

These and other further features and advantages of the invention would be apparent to those skilled in the art from the following detailed description, taken together with the accompanying drawings, in which:

BRIEF DESCRIPTION OF THE DRAWINGS

FIG. 1 shows a sectional view of one embodiment of a related LED lamp;

FIG. 2 shows a sectional view of another embodiment of a related LED lamp;

FIG. 3 shows the size envelope for a standard A19 replacement bulb;

FIG. 4 is a perspective view of one embodiment of an LED lamp according to the present invention;

FIG. 5 is a side elevation view of the LED lamp shown in FIG. 4;

FIG. 6 is a side sectional view of the LED lamp shown in FIG. 4;

FIG. 7 is a perspective view of another embodiment of an LED lamp according to the present invention;

FIG. 8 is perspective view of the LED lamp in FIG. 7, without a diffuser dome;

FIG. 10 is a side sectional view of the LED lamp shown in FIG. 7;

FIG. 12 is a side view of another embodiment of an LED lamp according to the present invention;

FIG. 13 is a side sectional view of another embodiment of an LED lamp according to the present invention; and FIG. 14 is a side sectional view of another embodiment of an LED lamp according to the present invention.

DETAILED DESCRIPTION OF THE INVENTION

Figure 9:
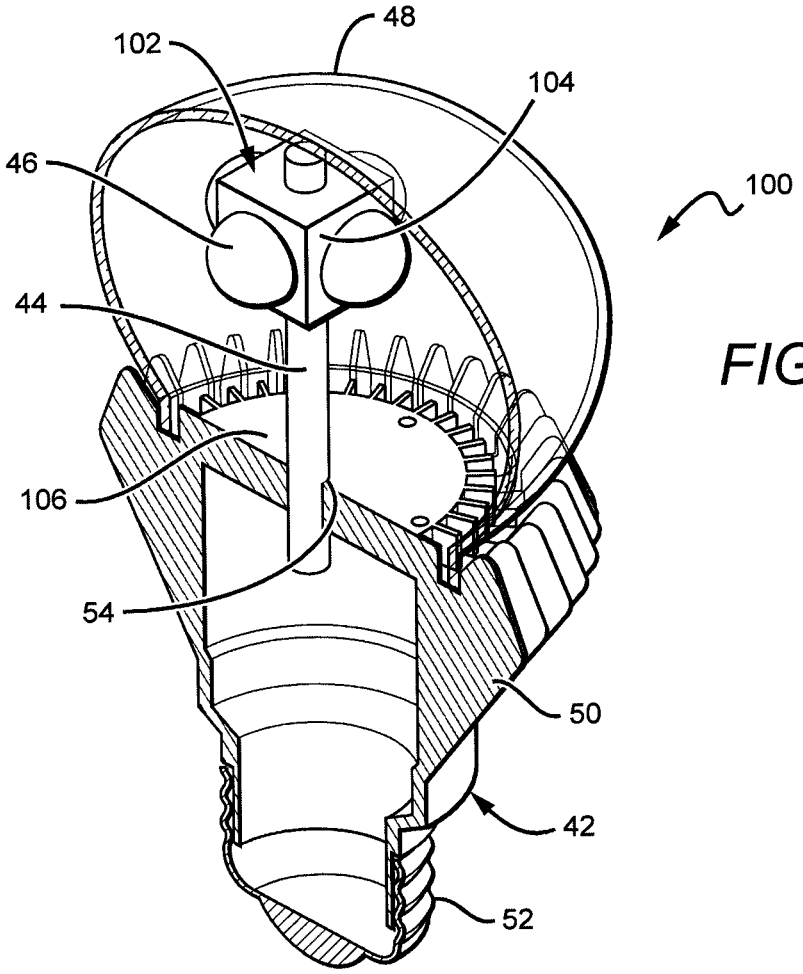
FIG. 9 is a perspective sectional view of the LED lamp shown in FIG. 7.

The present invention is directed to different embodiments of solid state lamp structures that in some embodiments provide elevating elements to mount LED chips or packages ("LEDs") above the lamp base. The elevating elements can comprise many different thermally conductive materials, as well as multiple material devices arranged to conduct heat. In some embodiments, the elements can comprise one or more heat pipes, with the LEDs mounted to the one end of and in thermal contact with the heat pipe. The other end of the heat pipe can be mounted to the lamp base with the heat pipe in an orientation to elevate the LEDs above the base. The heat pipes also conduct heat from the LEDs to the lamp base where the heat can efficiently radiate into the ambient. This arrangement allows for the LEDs to operate at a lower temperature, while allowing the LEDs to remain remote to the lamp base, which can be one of the lamp's primary heat dissipation features. This in turn allows for the LEDs to be driven with a higher drive signal to produce a higher luminous flux. Operating at lower temperatures can provide the additional advantage of improving the LED emission and increase the LED lifespan.

Heat pipes are generally known in the art and are only briefly discussed herein. Heat pipes can comprise a heat-transfer device that combines the principles of both thermal conductivity and phase transition to efficiently manage the transfer of heat between two interfaces. At the hot interface (i.e. interface with LEDs) within a heat pipe, a liquid in contact with a thermally conductive solid surface turns into a vapor by absorbing heat from that surface. The vapor condenses back into a liquid at the cold interface, releasing the latent heat. The liquid then returns to the hot interface through either capillary action or gravity action where it evaporates once more and repeats the cycle. In addition, the internal pressure of the heat pipe can be set or adjusted to facilitate the phase change depending on the demands of the working conditions of the thermally managed system.

A typical heat pipe includes a sealed pipe or tube made of a material with high thermal conductivity such as copper or aluminum at least at both the hot and cold ends. A vacuum pump can be used to remove air from the empty heat pipe, and the pipe can then be filled with a volume of working fluid (or coolant) chosen to match the operating temperature. Examples of such fluids include water, ethanol, acetone, sodium, or mercury. Due to the partial vacuum that can be near or below the vapor pressure of the fluid, some of the fluid can be in the liquid phase and some will be in the gas phase.

This arrangement of elevating the LEDs on a heat pipe can provide a number of additional advantages beyond those mentioned above. Remote placement of the LEDs on a heat pipe can allow for a concentrated LED light source that more closely resembles a point source. The LEDs can be mounted close to one another on the heat pipe, with little dead space between adjacent LEDs. This can result in a light source where the individual LEDs are less visible and can provide overall lamp emission with enhanced color mixing. By elevating the LED light source, greater angles of light distribution are also available, particularly emission in the down direction (compared to planar source on base). This allows the lamps to produce more omnidirectional emission pattern, with some embodiments comprising an emission pattern with intensity variation of approximately ±20 percent or less. Still other embodiments can comprise an emission pattern having an omnidirectional emission pattern with intensity variation of approximately ±15 percent or less.

In some embodiments the emission patterns can meet the requirements of the ENERGY STAR® Program Requirements for Integral LED Lamps, amended Mar. 22, 2010, herein incorporated by reference. The elevated LEDs along with the relative geometries of the lamp elements can allow light to disperse within 20% of mean value from 0 to 135 degrees with greater than 5% of total luminous flux in the 135 to 180 degree zone (measurement at 0, 45 and 90 azimuth angles). The relative geometries can include the lamp mounting width, height, head dissipation devices width and unique downward chamfered angle. Combined with a diffuser dome, the geometries can allow light to disperse within these stringent ENERGY STAR® requirements.

The present invention can reduce the surface areas needed to dissipate LED and power electronics thermal energy and still allow the lamps to comply with ANSI A19 lamp profiles 30 as shown in FIG. 3. This makes the lamps particularly useful as replacements for conventional incandescent and fluorescent lamps or bulbs, with lamps according to the present invention experiencing the reduced energy consumption and long life provided from their solid state light sources. The lamps according to the present invention can also fit other types of standard size profiles including but not limited to A21 and A23.

Different embodiments can be used with diffuser domes and by concentrating the light source on the heat pipe within the diffuser dome, there can be an increased distance between the light source and the diffuser. This allows for greater color mixing as the light emits from the LEDs and as the light passes through the diffuser dome. LED lamps according to the present invention can also have power supply units that generate heat and are typically located in the lamp base. Elevating of the LEDs above the base on heat pipe separates the heat generating LEDs from the heat generating power supply units. This reduces thermal "cross-talk" between the two and allows for both to operate at lower temperatures. The remote arrangement can also allow for directional positioning of the LEDs on the heat pipe to provide the desired lamp emission pattern. This directional emission can be provided from LEDs mounted to different up and down angled surfaces to provide the desired emission.

In the embodiments utilizing a diffuser, the diffuser not only serves to mask the internal components of the lamp from the view by the lamp user, but can also disperse or redistribute the light from the remote phosphor and/or the lamp's light source into a desired emission pattern. In some embodiments the diffuser can be arranged to assist in disperse light from the LEDs on the heat pipe into a desired omnidirectional emission pattern.

The properties of the diffuser, such as geometry, scattering properties of the scattering layer, surface roughness or smoothness, and spatial distribution of the scattering layer properties may be used to control various lamp properties such as color uniformity and light intensity distribution as a function of viewing angle. By masking the internal lamp features the diffuser can provide a desired overall lamp appearance when the lamp or bulb is not illuminated.

The lamp base can also comprise a heat sink structure with the heat pipe arranged in thermal contact with the heat sink structure. In some embodiments, the heat sink structure can comprise heat dissipating fins to radiate heat from the heat sink structure to the ambient. The lamp base can also comprise a means for connecting the lamp to a power source, such as a connector to connect to an Edison type socket, etc.

The features of the different lamp embodiments described herein can provide a solid state lamp that produces an emission pattern that more closely matches a traditional incandescent light bulb in form and function. These features also allow for emission with the intensity, temperature and color rendering index (CRI) that also resembles those of a traditional incandescent light bulb. This allows some lamp embodiments having the advantages of a solid state light source, such as LEDs, that are particularly applicable to uses as replacement bulbs for incandescent bulbs.

Lamps have been developed that utilize a larger shaped remote phosphor that can convert some the LED light. These larger phosphors, however, can result in higher material costs for the larger remote phosphor, and an envelope for the lamp. The present invention is arranged such that white emitting LEDs providing the desired CRI and color temperature can be mounted to the heat sink to provide the desired lamp emission. This allows for some lamps according to the present invention to operate without the complexity and expense of a remote phosphor, such as a phosphor globe.

It is understood, however, that other embodiments of LED lamps according to the present invention can be used in combination with a shaped remote phosphor, with the remote phosphor also being mounted to the heat sink. The remote phosphor can take many different shapes, such as a general globe-shape with the heat pipe at least partially arranged within the globe shaped phosphor. This can provide an arrangement with the desired color uniformity by the heat pipe and its emitters providing an approximate point light source within the remote phosphor. Many different remote phosphors are described in U.S. patent application Ser. No. 13/018,245, titled "LED Lamp with Remote Phosphor and Diffuser Configuration", filed on Jan. 31, 2011, which is incorporated herein by reference.

The present invention is described herein with reference to certain embodiments, but it is understood that the invention can be embodied in many different forms and should not be construed as limited to the embodiments set forth herein. In particular, the present invention is described below in regards to certain lamps or lighting components having LEDs, LED chips or LED components ("LEDs") in different configurations, but it is understood that the present invention can be used for many other lamps having many different configurations. The components can have different shapes and sizes beyond those shown and different numbers of LEDs or LED chips can be included. Many different commercially available LEDs can be used such as those commercially available LEDs from Cree, Inc. These can include, but are not limited to Cree's XLamp® XP-E LEDs or XLamp® XP-G LEDs.

It is also understood that when an element such as a layer, region or substrate is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one layer or another region. It is understood that these terms are intended to encompass different orientations of the device in addition to the orientation depicted in the figures.

Embodiments of the invention are described herein with reference to cross-sectional view illustrations that are schematic illustrations of embodiments of the invention. As such, the actual thickness of the layers can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the invention.

FIGS. 4-6 show one embodiment of a solid state lamp 40 according to the present invention that can comprise a lamp base 42, heat pipe 44 and LEDs 46, with heat pipe 44 mounted vertically to the lamp base 42 and with the LEDs 46 mounted to the end of the heat pipe 44 opposite the lamp base 42. A diffuser dome 48 can also be mounted to the lamp base over the heat pipe 44 and LEDs 46. The lamp base 42 can be arranged in many different ways, with many different features, in the embodiment shown it comprises a heat sink structure 50 and connector 52 for connecting to a source of electrical power. The heat sink structure 50 can at least partially comprise a thermally conductive material, and many different thermally conductive materials can be used including different metals such as copper or aluminum, or metal alloys. Copper can have a thermal conductivity of up to 400 W/m-k or more. In some embodiments the heat sink can comprise high purity aluminum that can have a thermal conductivity at room temperature of approximately 210 W/m-k. In other embodiments the heat sink structure can comprise die cast aluminum having a thermal conductivity of approximately 200 W/m-k.

The heat sink structure 50 can also comprise a smooth outer surface and in other embodiments can comprise other heat dissipation features such as heat fins that increase the surface area of the heat sink to facilitate more efficient dissipation into the ambient. In some embodiments, the heat fins can be made of same material or a material with higher thermal conductivity than the remainder of the heat sink structure. The heat fins have a generally vertical orientation, but it is understood that in other embodiments the fins can have a horizontal or angled orientation, or combinations of different orientations. In still other embodiments, the heat sink can comprise active cooling elements, such as fans, to lower the convective thermal resistance within the lamp.

The base 42 can also comprise different areas of solid heat conducting material and different open areas to house lamp features such as a power supply unit as described below. In some embodiments the portion above the connector 52 can comprise a substantially solid heat conducting material, with some embodiments having heat fins that radiate out from the solid material. The heat pipe 44 can be mounted to the lamp base using many different mounting methods and materials. As best shown in FIG. 6, some lamp embodiments can comprise a countersunk hole 54 in the heat conductive solid portion of the base, with the hole 54 provided at the desired angle of the heat pipe 44 and in the desired location of the heat pipe. In the embodiment shown, the hole 54 has a generally vertical orientation and is located in general alignment with the longitudinal axis of the lamp base 42.

The heat pipe 44 can be held in place using many different material and mechanisms, and in the embodiment shown be bonded in countersunk hole 54 using different materials, such as thermally conductive materials that allow heat to spread from the heat pipe 44 to the lamp base 42. One suitable binding material comprises a thermal epoxy, but it is understood that many different thermally conductive materials can be used such as thermally conductive grease. Conventional thermally conductive grease can contain ceramic materials such as beryllium oxide and aluminum nitride or metal particles such as colloidal silver. In one embodiment a thermal grease layer is used having a thickness of approximately 100 μm and thermal conductivity of k=0.2 W/m-k. This arrangement provides an efficient thermally conductive path for conducting heat from the heat pipe 44 to the heat sink structure 50.

It is also understood that the arrangement shown in FIG. 6 is only one of the many mounting arrangements that can be used in LED lamps according to the present invention. In other embodiments the heat pipe 44 can be mounted to the heat sink structure 50 by thermal conductive devices such as by clamping mechanisms, brackets, or screws. These devices can hold the heat pipe tightly to the heat sink structure 50 to maximize thermal conductivity.

The connector 52 is included on the base 42 to allow for the lamp 40 to connect to a source of electricity such as to different electrical receptacles. In some embodiments, such as the one shown in FIGS. 4-6, the lamp base 42 can comprise a feature of the type to fit in and mount to a conventional standard Edison socket, which can comprise a screw-threaded portion which can be screwed into an Edison socket. In other embodiments, it can include a standard plug and the electrical receptacle can be a standard outlet, or can comprise a GU24 base unit, or it can be a clip and the electrical receptacle can be a receptacle which receives and retains the clip (e.g., as used in many fluorescent lights). These are only a few of the options for heat sink structures and receptacles, and other arrangements can also be used that safely deliver electricity from the receptacle to the lamp 50.

As best shown in FIG. 6, The lamps according to the present invention can also comprise an internal power supply unit (or power conversion unit) 55. In the embodiment shown, the power supply unit 55 can comprise a driver to allow the lamp to run from an AC line voltage/current and to provide light source dimming capabilities. In some embodiments, the power supply can comprise an offline constant-current LED driver using a non-isolated quasi-resonant flyback topology. The power supply unit 55 can fit within the lamp base 42 and in the embodiment shown is generally arranged in the electrical connector 52. In some embodiments the power supply unit 55 can comprise a less than 25 cubic centimeter volume, while in other embodiments it can comprise an approximately 20 cubic centimeter volume. In still other embodiments the power supply unit can be non-dimmable but is low cost. It is understood that the power supply used can have different topology or geometry and can be dimmable as well.

As mentioned above, the LEDs 46 can be mounted to the heat pipe 44 at different locations, with a suitable location being at or near the end of the heat pipe 44 opposite the lamp base 42. The LEDs 46 can be mounted in many different ways, but should be mounted such that there is an efficient thermal path from the LEDs 46 to the heat pipe 44. In some embodiments, the LEDs 46 can be mounted directly to the heat pipe 44 by a thermally conductive material such as a solder. In the embodiment shown, a conductive block 56 of conductive material is provided at or near the top of the heat pipe 44, with the block 56 being in thermal contact with the heat pipe 44. The conductive block 56 can be made of many different thermally conductive materials such as copper, conductive plastic, or aluminum, and can be bonded with a conductive material to provide the efficient conductive path between the block 56 and the heat pipe 44. The block 56 provides planar surfaces that can be compatible with mounting LEDs and LED packages.

The lamps according to the present invention can utilize different numbers of LEDs or LED packages, with the embodiment shown having two LEDs 46 mounted to opposing sides of the conductive block 56. It is understood that other embodiments can have more LEDs, and in some embodiments it may be advantageous to have an LED mounted to the top of the block 56 or on more than two surfaces of the conductive block 56 to provide the desired emission pattern. The conductive block 56 has a cube shape, but it is understood that the block can have different shapes that have more or less side surfaces, or can have surfaces angled in one direction, such as up in the case of a pyramid, or having surfaces angled in both up and down directions, such as in the case of a diamond. It is understood that the block can take many different shapes having different numbers of up or down angled surfaces, with different embodiments having four or more planar surfaces, including the bottom facing surface.

In the embodiment shown the block 56 is arranged to hold two LEDs 46, with each on opposing sides of the block 56. The conductive block 56 is thinner on the uncovered side surfaces to bring the back-to-back LEDs 46 in closer proximity to one another so that the overall light source more closely resembles a point light source. The LEDs are arranged at a height within the diffuser dome to provide the desired lamp emission pattern. By raising the LEDs 46 above the lamp base on the heat pipe 44, the LEDs 46 can directly emit light in the down direction past the lamp base 42. This is best shown by representative light ray 59 shown in FIG. 5. This direct downward emission allows for the lamp 40 to more easily provide a desired omnidirectional lamp emission pattern.

As mentioned above, the diffuser 48 can be arranged to disperse light from the phosphor carrier and LED into the desired lamp emission pattern, and can have many different shapes and sizes. In some embodiments, the diffuser also can be arranged over the phosphor carrier to mask the phosphor carrier when the lamp is not emitting. The diffuser can have materials to give a substantially white appearance to give the bulb a white appearance when the lamp is not emitting.

Many different diffusers with different shapes and attributes can be used with lamp 40 as well as the lamps described below, such as those described in U.S patent application Ser. No. 13/018,245, which is incorporated by reference above. This patent is titled "LED Lamp With Remote Phosphor and Diffuser Configuration", and was filed on Jan. 31, 2011. The diffuser can also take different shapes, including but not limited to generally asymmetric "squat" as in U.S. patent application Ser. No. 12/901,405, titled "Non-uniform Diffuser to Scatter Light into Uniform Emission Pattern," filed on Oct. 8, 2010, and incorporated herein by reference.

A reflective layer(s) or materials can also be included on surfaces of the heat sink structure 50 and on the heat pipe 44 to reflect light from the LEDs. In one embodiment, the top surface 58 of the heat sink structure 50 around the heat pipe 44 can comprise a reflective layer 60 that can be made of many different materials deposited and formed on the heat sink structure using known methods. These reflective layers 60 allow for the optical cavity to effectively recycle photons, and increase the emission efficiency of the lamp. In some embodiments the surfaces can be coated with a material having a reflectivity of approximately 75% or more to the lamp visible wavelengths of light emitted by the LEDs 46, while in other embodiments the material can have a reflectivity of approximately 85% or more to the LED light. In still other embodiments the material can have a reflectivity to the LED light of approximately 95% or more. It is understood that the reflective layer can comprise many different materials and structures including but not limited to reflective metals or multiple layer reflective structures such as distributed Bragg reflectors.

During operation of the lamp 40, an electrical signal from the connector 52 can be conducted to the power supply unit 55, and a drive signal can then be conducted to the LEDs 46 causing them to emit light. The signal from the power supply unit 55 can be conducted to the LEDs 46 using known conductors that can run to the LEDs along the heat pipe 44. In some embodiments a sleeve can be included around the heat pipe in which the conductors can run, with some sleeve embodiments having a reflective surface. In still other embodiments, a drive circuit or drive board (not shown) can be included between the power supply unit and the LEDs 46 to compensate for changes in LED emission over time and at different temperatures. This drive circuit can be in many different locations in the LED lamp 40 such as on the top surface 58 of the heat sink structure.

As the LEDs 46 emit light, they generate heat that can be conducted to the conductive block 56, and on to the top portion of the heat pipe 44. The heat pipe 44 then conducts heat to the lamp base 42 and its heat sink structure 50, where the heat can dissipate into the ambient. This provides efficient management of the heat generated by the LEDs 46, and allows for the LEDs to operate at cooler temperatures.

FIGS. 7-10 show another embodiment of an LED lamp 100 according to the present invention that is similar to the lamp 40 shown in FIGS. 4-6, and for the same or similar features the same reference numbers are used with the understanding the description above for these elements applies to this embodiment. The lamp 100 can comprise a lamp base 42, heat pipe 44, LEDs 46 and diffuser dome 48. The base 42 also comprises a heat sink structure 50 and electrical connector 52, with the heat sink structure 50 having a countersunk hole 54 for the heat pipe 44. The heat sink structure 50 can also comprise a reflective layer 60 on the heat sink structure's top surface, and the heat pipe can also be covered by a reflective layer.

The lamp 100 also comprises a conductive block 102 that can be made of the same materials as conductive block 56 shown in FIGS. 4-6, but has a somewhat different shape and arranged to accommodate different numbers of LEDs, with the embodiment shown accommodating four LEDs 46. The block 102 has four side surfaces 104 that are substantially the same size with each capable of holding one of the LEDs 46. The side surfaces should be sized so that the LEDs 46 are close to one another while still allowing for the necessary electrical connection to the LEDs 46, as well as the desired thermal dissipation of heat away from the LEDs 46 and into the heat pipe. As discussed above, by bringing the LEDs 46 close to one another, the LEDs 46 can more closely approximate a point light source.

The heat sink structure 50 can also comprise heat fins 105 that radiate out from a center heat conductive core 106, with the heat fins 105 increasing the surface area for heat to dissipate. Heat from the heat pipe 44 spreads into the conductive core 106 and then spreads into the heat fins 105, where it spreads into the ambient. The heat fins 105 can take many different shapes and can be arranged in many different ways, with the heat fins 105 arranged vertically on the conductive core 106. The fins angle out and become larger moving up the heat sink structure 50 from the electrical connector 52, and then angle back toward the top of the heat sink structure 50. The lower portion can angle out in a way to allow LED lamp to fit within a particular lighting size envelope, such as A19 size envelopes. The fins angle back in to allow for light from the LEDs to emit down at the desired angle without being blocked be the fins 105.

The top of the fins 105 also comprise a slot 108 (best shown in FIG. 8) for holding the bottom edge of the diffuser dome 48. As best shown in FIG. 10, the fins 105 begin at the core 106 at a point within the diffuser dome 48 so that a portion of the fins 105 are within the bottom edge of the diffuser dome 48. This provides opening between the fins to allow air to pass from the interior of the diffuser dome 48 to along the spaces between the heat fins 105, and vice versa. This allows for heated air to pass from within the diffuser dome, also assisting in keeping the LEDs operating at the desired temperature.

Figure 11:
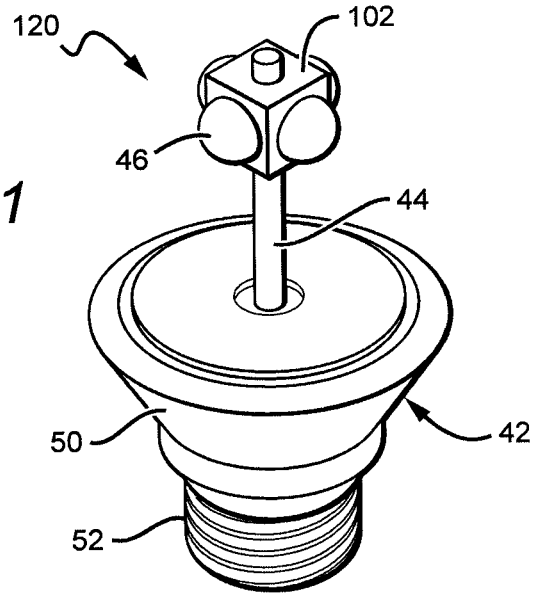
FIG. 11 is a perspective view of another embodiment of an LED lamp according to the present invention.

The different LED lamps according to the present invention can be arranged in many different ways, with many different features. FIG. 11 shows another embodiment of an LED lamp 120 according to the present invention also having base 42, heat pipe 44, and LEDs 46, and is arranged to accommodate a diffuser dome (not shown). In this embodiment, the base comprises a heat sink structure 50 and electrical connector 52 similar to those shown in FIGS. 4-6, but also comprises a conductive block 102 having side surfaces to accommodate four LED chips, as described above with reference to FIGS. 7-10.

FIG. 12 shows still another embodiment of an LED lamp 150 according to the present invention, heat pipe 44, LEDs 46 and diffuser dome (or lens) 48. This embodiment comprises a lamp base 152 having an electrical connector 154 to connect to a source of electrical power. The base 152 further comprises an active cooling element 156 such as a fan that actively moves air around the LED lamp to keep the lamp element at the desired temperature. It is understood that the LED lamp 150 can also comprise a heat sink structure that operates in cooperation with the active cooling element 156, and in some embodiments the heat sink structure can comprise heat fins as described above that allow air flow to the interior of the diffuser dome. Different active cooling LED lamp active cooling elements are described in U.S. patent application Ser. No. 12/985,275, titled "LED Bulb with Integrated Fan Element for Enhanced Convective Heat Dissipation, filed on Jan. 5, 2011, and in U.S. patent application Ser. No. 13/022,490, titled "LED Lamp with Active Cooling Element," filed on Feb. 7, 2011, both of which are incorporated herein by reference.

The LED lamp 150 also comprises a conductive block 158 that is mounted to the top of and in thermal contact with the heat pipe 44. The conductive block 158 is arranged such that its top surface 160 is available for mounting an LED 46. The conductive block 158 can accommodate LEDs 46 on its top surface 160 as well as its side surfaces 162. If each surface held a single LED 46, the block 158 can hold up to five LEDs, but it is understood that each surface can hold more than one LED.

As mentioned above, the heat pipes can be mounted to their lamp base using many different mechanisms and materials. FIG. 13 shows still another embodiment of an LED lamp 170 according to the present invention, having a lamp base 42 and a heat pipe 44. In the embodiment shown in FIGS. 4-6 and described above, the heat pipe was mounted within a longitudinal (vertical) hole using a conductive bonding material. In LED lamp 170, the heat pipe 44 has an angled section 172 mounted within the base. The angled section 172 provides a greater portion of the heat pipe 44 that can be held within the lamp base 42 providing a greater surface area for conducting heat from the heat pipe 44 into the lamp base 42. This can allow for the base to dissipate a higher level of heat from the heat pipe. This is only one of the many different shapes that the heat pipe 44 can take in the lamp base 42.

Embodiments of the present invention can be arranged in many different ways beyond those described above. By way of example, FIG. 14 shows another embodiment of an LED lamp 200 according to the present invention that can comprise two heat pipes 202, 204, arranged in the same way as the heat pipes above, with each heat pipe having one or more LEDs 206 mounted on a conductive block 208. Each of the LEDs 206 is also mounted to its respective conductive block such that its emission is directed out from the longitudinal axis of the lamp toward the diffuser dome 210. By having more than one heat pipe, this arrangement may provide enhanced heat dissipation capabilities, and may provide additional flexibility in generating the desired lamp emission pattern. It is also understood that the heat pipes according to the present invention can have many different shapes, sizes and angles, and can be mounted within the lamps in many different ways and locations.

Although the present invention has been described in detail with reference to certain preferred configurations thereof, other versions are possible. Therefore, the spirit and scope of the invention should not be limited to the versions described above.

I claim:

1. A solid state lamp, comprising:

a solid state light source;

a lamp base at least partially comprising a heat conductive material and heat fins, wherein said lamp base comprises a power supply unit;

an elongated elevating element mounted to said lamp base with said light source mounted to said elevating element such that said light source is above said lamp base, said elevating element being at least partially heat conductive, wherein said light source is mounted to a first end of said elevating element with a second end of said elevating element mounted to said lamp base;

a conductive block mounted to and in thermal contact with said elevating element, said light source mounted to said conductive block, wherein said conductive block comprises a plurality of planar surfaces for said light source; and a diffuser to diffuse light emitting from said lamp into a desired emission pattern, such that said diffuser is proximate to said elongated elevating element and a substantial portion of both said elongated elevating element and said diffuser are above said lamp base, said heat fins, and said heat conductive material;

wherein a portion of each of said heat fins is within the bottom of said diffuser.

2. The lamp of claim 1, wherein said solid state light source comprises a plurality of light emitting diodes (LEDs).

3. The lamp of claim 1, wherein said solid state light source comprises a plurality of LEDs, each of which is emitting in a different direction.

4. The lamp of claim 1, wherein said elevating element comprises a heat pipe.

5. The lamp of claim 1, wherein said light source comprises one or more LEDs.

6. The lamp of claim 1, wherein said light source is in thermal contact with said elevating element, and said elevating element is in thermal contact with said lamp base.

7. The lamp of claim 1, comprising a thermally conductive path from said light source, through said elevating element, to said lamp base and to the ambient.

8. The lamp of claim 1, wherein said emission pattern is omnidirectional.

9. The lamp of claim 1, wherein said lamp base comprises a heat sink.

10. The lamp of claim 1, wherein said lamp base comprises an electrical connector.

11. The lamp of claim 1, wherein said diffuser comprises a diffuser dome.

12. The lamp of claim 1, wherein said solid state light source comprises a plurality of LEDs, with at least some of said LEDs mounted on different surfaces of said conductive block.

13. The lamp of claim 1, wherein said light source comprises two LEDs, each of which is mounted on a respective surface of said conductive block.

14. The lamp of claim 1, wherein said light source comprises four LEDs, each of which is mounted on a respective surface of said conductive block.

15. The lamp of claim 1, wherein said light source comprises five LEDs, each of which is mounted on a respective surface of said conductive block.

16. The lamp of claim 1, wherein said conductive block has four or more planar surfaces.

17. The lamp of claim 1, wherein said solid state light source comprises a plurality of LEDs, with at least some of said LEDs mounted on opposite sides of said conductive block.

18. The lamp of claim 1, wherein said emission pattern comprises intensity variation of approximately +20 percent or less.

19. The lamp of claim 1, wherein said emission pattern comprises an intensity variation of approximately +15 percent or less.

20. The lamp of claim 1, wherein said elongating element comprises more than one heat pipe.

21. The lamp of claim 20, wherein said light source comprises a plurality of LEDs, wherein each said heat pipe has at least one of said LEDs.

22. The lamp of claim 21, wherein the emission of each said LED is directed toward said diffuser.

23. A light emitting diode (LED) based bulb, comprising:

a heat pipe;

a plurality of LEDs, each of which is mounted at or near a first end of, and in thermal contact with, said heat pipe, said heat pipe comprising a thermally conductive path to conduct heat away from said LEDs;

a conductive block mounted to and in thermal contact with said heat pipe, said LEDs mounted to said conductive block; and a lamp base at least partially comprising a heat conductive material and a plurality of heat fins, the second end of said heat pipe mounted to, and in thermal contact with, said lamp base, said lamp base comprising a thermally conductive path to conduct heat away from said heat pipe, wherein said lamp base comprises a power supply unit;

a diffuser to diffuse light emitting from said bulb, wherein a portion of at least some of said heat fins is within the bottom of said diffuser.

24. The bulb of claim 23, wherein heat from said lamp base dissipates to the ambient.

25. The bulb of claim 23, said diffuser in relation to said LEDs so that light from said LEDs passes through said diffuser.

26. The bulb of claim 25, wherein said diffuser modifies the emission pattern of said LEDs into an omnidirectional pattern.

27. The bulb of claim 25, wherein said diffuser comprises a diffuser dome.

28. The bulb of claim 27, wherein said diffuser is at least partially over said LEDs, and wherein said LEDs approximate a point light source within said diffuser dome.

29. The bulb of claim 23, wherein said lamp base comprises a heat sink structure.

30. The bulb of claim 29, wherein said thermally conductive path to conduct heat away from said heat pipe is through said heat sink structure.

31. The bulb of claim 29, wherein said heat sink further comprises heat fins.

32. The bulb of claim 23, having an omnidirectional emission pattern with intensity variation of approximately +20 percent or less.

33. The bulb of claim 23, having an omnidirectional emission pattern with intensity variation of approximately +15 percent or less.

34. The bulb of claim 23, wherein said conductive block comprises a plurality of planar surfaces, each of said LEDs mounted to one of said planar surfaces.

35. The bulb of claim 23, further comprising a screw-threaded portion for mounting said bulb to an Edison socket.

36. The bulb of claim 23, comprising an A-bulb replacement.

37. A solid state lamp, comprising:

a plurality of heat pipes, each of said heat pipes having a plurality of solid state light sources, in thermal contact with said heat pipe, a conductive block mounted to and in thermal contact with said heat pipe, said light sources mounted to said conductive block, wherein at least two of said light sources are facing different directions;

a heat sink structure, said heat pipe thermally coupled to said heat sink structure with heat from said solid state light sources conducting to said heat sink structure through said heat pipe, said heat sink structure including power circuitry; and a diffuser with at least some light from said light sources passing through said diffuser.

38. The lamp of claim 37, wherein said diffuser disperses light from said light sources into an omnidirectional pattern.

39. The lamp of claim 37, wherein said light sources approximate a point light source within said diffuser.

* * * * *